United States Patent [19]

Falgout, Sr.

[11] Patent Number: 4,770,258

[45] Date of Patent: Sep. 13, 1988

[54] WELL DEVIATION CONTROL TOOL

[76] Inventor: Thomas E. Falgout, Sr., Rte. 2, Box 11B, Youngsville, La. 70592

[21] Appl. No.: 42,852

[22] Filed: Apr. 27, 1987

[51] Int. Cl.[4] ..... E21B 17/10

[52] U.S. Cl. ..... 175/73; 175/325; 166/241

[58] Field of Search ..... 175/61, 73, 74, 325; 166/241

[56] References Cited

U.S. PATENT DOCUMENTS

| | | | |
|---|---|---|---|
| 3,043,381 | 7/1962 | McNelly, Jr. | 175/73 |
| 3,045,767 | 7/1962 | Klassen | 175/76 |
| 3,154,156 | 10/1964 | Moore et al. | 175/76 |
| 3,298,449 | 1/1967 | Bachman et al. | 175/76 |
| 3,352,370 | 11/1967 | Livingston | 175/73 |
| 4,076,084 | 2/1978 | Tighe | 175/73 |
| 4,102,552 | 7/1978 | Kellner | 308/4 A |
| 4,220,213 | 9/1980 | Hamilton | 175/325 X |
| 4,284,154 | 8/1981 | England | 166/241 X |
| 4,549,613 | 10/1985 | Case | 175/325 |
| 4,638,873 | 1/1987 | Welborn | 175/325 X |
| 4,715,453 | 12/1987 | Falgout, Sr. et al. | 175/73 |

*Primary Examiner*—Stephen J. Novosad
*Assistant Examiner*—William P. Neuder
*Attorney, Agent, or Firm*—John D. Jeter

[57] ABSTRACT

A length of drill string, or a sub, functions as a body to which an encircling sleeve is rotationally and axially secured. The sleeve is arranged to permit some radial movement on the body and is spring biased in one radial directiion. A radial projection of some axial length extends from the sleeve in the biased direction to engage the well bore wall. During drill string rotation, the projection engages a near side wall more forcefully than other parts of the well bore periphery. The forceful engagement between projection and wall deranges the tendency for a curved drill string centerline to lie in a stationary plane when the drill bit has a tendency to depart from an original course while drilling. The bias allows the sleeve to be pushed toward a more centralized position on the body but the fluid damping inherent by changing clearances between sleeve and body, while the tool is immersed in drilling fluid, retards the centralizing movement. The damping effect is influenced by drill string rotation and the rotation speed can be controlled from the surface.

10 Claims, 2 Drawing Sheets

WELL DEVIATION CONTROL TOOL

The present invention pertains to drill string components used to apply lateral forces to well bore walls to urge a drill string to a selected position relative to well bore centerlines to influence the course of well bores during drilling.

EXISTING ART

A variety of apparatus has evolved to apply lateral forces between a well bore wall and a drill string to influence the course of advancing drilling assemblies. Typical U.S. patents pertaining to lateral force apparatus are listed below:

(1) U.S. Pat. No. 3,352,370, Nov. 14, 1967, to H. G. Livingston.

(2) U.S. Pat. No. 3,298,449, Jan. 17, 1967, to Bachman, et al.

(3) U.S. Pat. No. 3,043,381, July 10, 1962, to B. M. McNeely, Jr.

(4) U.S. Pat. No. 3,045,767, July 24, 1962, to W. G. Klasson.

The U.S. Pat. No. 4,715,453, issued Dec. 29, 1987, discloses a lateral force tool that accomplishes much the same result as the present invention but it does so by quite different processes.

BACKGROUND

All lateral force apparatus known to have been put into field service have failed to achieve confidence in the application results. They apparently do not respond uniformly to the varied conditions encountered downhole.

By way of definition, stablilzers are not considered to be lateral force tools, although they certainly apply lateral forces to the well bore wall. Lateral force tools are considered to be those tools with active elements that move in order to apply more lateral force in one place than another about the well bore periphery.

The tool of this invention and tool of the copending application previously mentioned have been in experimental service and appear to perform as intended in the limited field trials to date.

Lateral force tools that respond to displacement of the drill string centerline from the well bore centerline to exert forces in selected transverse directions may be combined with conventional string stabilizers to yield various effects upon the drill bit. By combining the lateral force tool with one stabilizer arrangement, for instance, the drilling assembly will build angle in a deviated hole. The same tool may be combined with a different stabilizer arrangement under the same drilling conditions and drop angle. Such techniques are well known to those skilled in the art of directional drilling.

It is therefore an object of this invention to provide a well drilling tool that will produce a reactive lateral force between the drill string and a well bore wall to influence the course followed by a drilling assembly.

It is another object of this invention to provide well tools that provide lateral forces on drill strings that are proportional to drill string rotational rate.

It is yet another object of this invention to provide a well drilling tool capable of extending a lateral force element against a well bore wall that is somewhat overgage.

It is still another object of this invention to provide a drilling tool that will provide a lateral force on the drill string that is limited and proportional to drill string rotation rate.

SUMMARY OF THE INVENTION

A length of drill string serves as a body on which an encircling sleeve is axially and rotationally confined. The sleeve is arranged for limited freedom of movement in a radial direction and is spring biased in that direction. A radial projection, of some axial length, extends from the sleeve in the biased direction. The sleeve is driven rotationally by the body, preferably, by a key on the body and a cooperating keyway in the sleeve. Opposed surfaces on the sleeve and body axially confine the sleeve on a body midsection called an arbor. The arbor may, alternatively, be made square and drive the sleeve by a cooperating rectangular bore in the sleeve. Whether keyed or square, the sleeve bore is of such size and shape that it may move some amount radially relative to the body. At least one spring is situated between the body and the sleeve to bias the sleeve in the direction of the projection. The space between the body and the sleeve is fluid filled when the tool is immersed in driling fluid and the fluid must move from one place to another when the sleeve moves radially on the body. The clearances through which the displaced fluid must move provides means to influence damping, or dash pit, effect. The effect of damping is influenced by drill string rotary speed and speed may be controlled from the earth surface.

When in use on a rotating drill string that is not in the center of the well bore, the radial projection will engage the well bore wall on the near side and the resulting torque on the sleeve will urge the drill string to move laterally in a direction perpendicular to a line from the projection leading edge to the drill string centerline. The sleeve will experience a force, applied by the well bore wall, that tends to overcome the spring and move the sleeve laterally away from the radial projection. Fluid damping, and inertia, will retard the movement of the sleeve on the body. The resulting net force on the drill string will be in a direction generally opposite the near side wall of the well. The effect of fluid damping will be influenced by drill string rotation rate and that factor provides means to influence the behavior of the tool by actions at the earth surface.

DETAILED DESCRIPTION OF DRAWINGS

Figure 1:
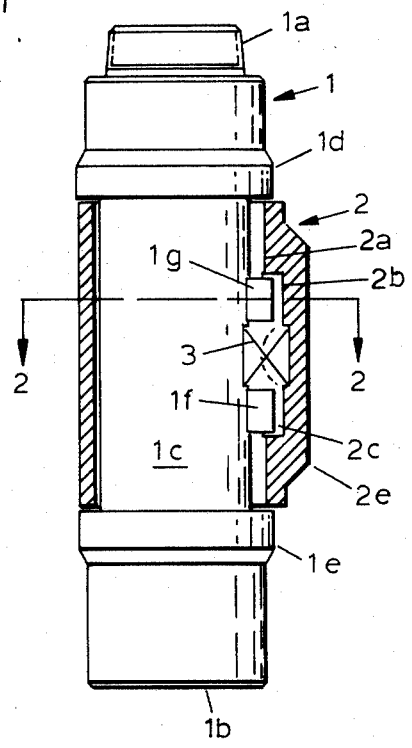
FIG. 1 is an elevation, partly cut away, of the preferred embodiment of the invention.

In the drawings, wherein like features have the same identifying reference characters, FIG. 1 represents the preferred embodiment of the invention. Body 1 is a short length of drill string, or a sub, with a tool joint pin 1*a* on the top, tool joint box 1*b* on the lower end and a bore (not shown) along the general centerline to conduct drilling fluid from end-to-end. Sleeve 2 is situated around the body midsection which forms arbor 1*c*. The sleeve has bore 2*a* which is somewhat larger than the arbor diameter. Collars, or integral flanges, 1*d* and 1*e* confine the sleeve on the arbor. Other opposed surface configurations may be used.

Keys 1*f* and 1*g* are structurally part of the sub and extend radially into cooperating keyways 2*c l and 2b* on the sleeve bore. Spring 3 is situated between the arbor and the sleeve and urges the sleeve radially to the right as viewed. The keyways are deep enough to allow the sleeve to move to the left on the arbor to the limit allowed by the dimensional clearance between arbor and sleeve bore.

Projection 2*e* is part of sleeve 2 and extends radially. The function of the projection will be described later.

Figure 2:
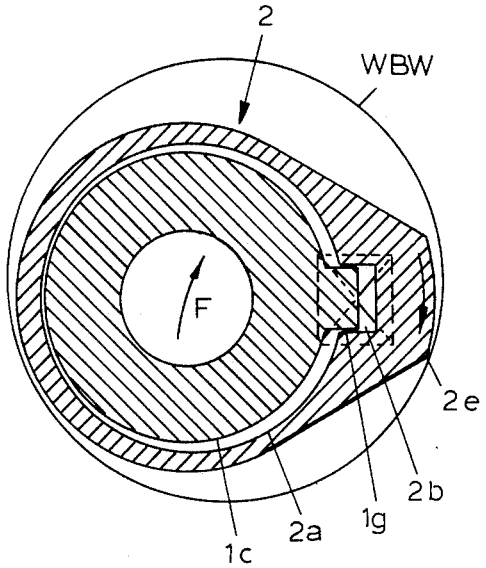
FIG. 2 is sectional view, somewhat enlarged, of the tool of FIG. 1 taken along line 2—2.

FIG. 2 is a sectional view, somewhat enlarged, taken along line 2—2 of FIG. 1. To better describe the function of the tool, a circle WBW represents the well bore wall. When viewed from above, the tool and drill string turn clockwise and projection 2*e* moves in the direction of the arrow in the projection. The projection engages the bore hole wall and torque produced due to forceful rotation of the sleeve causes the centerline of the arbor to be urged in the direction of arrow F. When the drill is normally not in the center of the well bore, there is a near side of the well bore wall relative to the drill string. Projection 2*e* will engage the near side of the well bore wall more forcefully than it will elsewhere as it progresses rotationally around the wall periphery. The force represented by arrow F will be proportional to the rotational resistance encountered by projection 2*e*. Arrow F is generally perpendicular to a line extending from the the leading edge of projection 2*e* to the centerline of arbor 1*c*. The arrow F will, hence, rotate with the drill string and change magnitude throughout the revolution.

Bias, or spring, 3 is situated to cause the sleeve to be displaced in the direction of the bias, and the keys 1*f* and 1*g*, when the projection is extending toward the well bore far side wall. When the projection encounters the near side wall, it will be urged to overcome the spring bias and push the sleeve toward the drill string. The sleeve does not move instantly and is retarded by inertia and fluid damping. Fluid damping results from displacement of drilling fluid from the clearance between the sleeve and the arbor. The drilling fluid moves from one place to another in the clearnce as the sleeve moves relative to the body. By shaping the clearance through which the displaced fluid moves, the desired dash pot effect can be caused. The drill string rotation rate will influence the fluid damping effect that the projection, in turn, can have upon movement of the drill string away from the well near side. Drill string rotation rate is considered in selecting bias loads and clearances through which displaced drilling fluid moves.

In the usual drilling situation that causes a well bore being drilled to depart from the extended centerline of the preceding well bore, the bit is deflected, usually by formation conditions, and the drill string curves under column load to make the departure more extreme. In the usual case, the curved drill string centerline, although rotating, stays in a stationary plane relative to earth. Drill string stabilizers are necessarily under gage so that they can proceed along the well bore as is is deepened. Stabilizers can retard but cannot prevent departure from the original well course, in the classic crooked hole country drilling case.

There are two principal effects produced by the tool of this invention. By occasionally forcing the drill string centerline to move away from the sleeve projection, the tendency of a load curved drill string to stay in a stationary plane is deranged. The long term net effect of the lateral force vector caused by the sleeve projection engaging the well near side wall is to urge the drill string centerline to a more central location in the well. The first effect helps prevent unwanted departure from a vertical hole. The second effect is usually combined with axial disposition of conventional stablilizers to cause secondary effects familiar to those skilled in the art. Secondary effects involve the use of active lateral force tools, used some axial distance from a stabilizer, to deflect a drill bit in a selected direction relative to the direction of the lateral force being used. The conventional stabilizer is usually considered a fulcrum.

The use of Measurement While Drilling (MWD) telemetry equipment, now available, allows drillers to determine the effect of tools while in use. Tools that change effect in response to changes in drill string rotation rate and bit loads offer the user some control from the surface. By deranging the common tendency of a loaded and deflected drill string to curve in a stationary plane, the drilling assembly is made less responsive to bit loads. The damping effect in the lateral force tool makes it more responsive to drill string rotation rate.

At very low rotation rates, the fluid damping has very little effect on the sleeve and only the influence of the bias is effective. At higher speeds, damping becomes more effetive in terms of influence on the drill string centerline. At very high rotational speeds, the bias wil not have time to laterally displace the sleeve to extend the projection and very little influence will be exerted by the tool. The driller can observe the effect being realized down hole, with MWD equipment, and make changes in operating parameters as required. When the tool of this invention is ideally matched to drilling conditions and formation characteristics, in terms of bias and damping, a change of only a few turns per minute should change the net effect downhole to that required.

Figure 3:
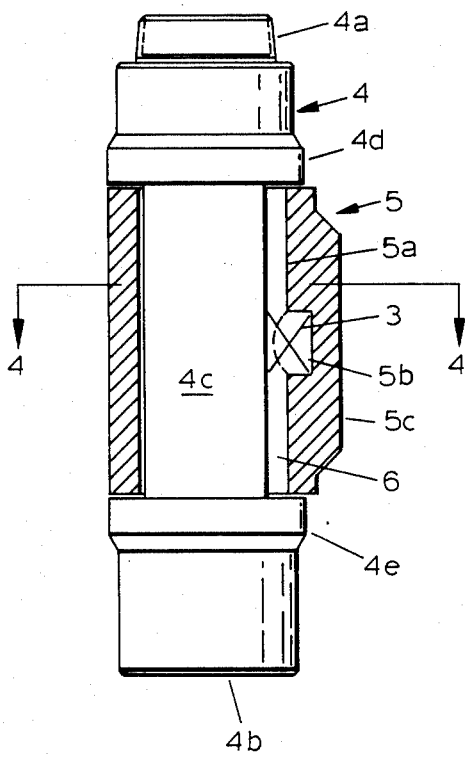
FIG. 3 is an elevation, partly cut away, of an alternate embodiment of the invention.

FIG. 3 represents a tool very much like that of FIG. 1 in terms of action but has a square arbor in the body midsection to rotationally drive the sleeve.

Figure 4:
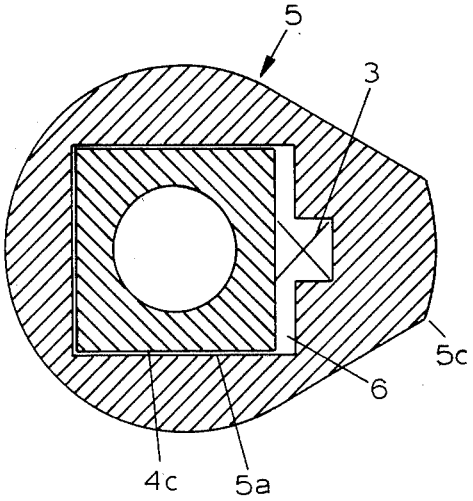
FIG. 4 is a sectional view, somewhat enlarged, of the tool of FIG. 3 taken along line 4—4.

Body 4, a length of drill string, or a sub, has tool joint pin 4*a* on the upper end, tool joint box 4*b* on the lower end and a bore (not shown) through the general center to conduct drilling fluid. Bias, or spring, 3 urges the sleeve 5 to the right, as viewed, to the limit of travel allowed by the rectangular sleeve bore 5*a* clearances relative to square arbor 4*c*. The sleeve is axially confined by collars, or flanges, 4*d* and 4*e* which are structurally part of the body. When the sleeve is in the position shown, space 6 is filled by ambient fluid that has to be expelled through clearances between body and sleeve when the sleeve moves leftward. This represents a fluid damping menas. Recess 5*b* in sleeve 5 provides room for spring 3. Projection 5*c* serves the same function as that described for projection 2*e* of FIG. 2. The tool of FIGS. 3 and 4 performs as described for FIGS. 1 and 2.

Figure 5:
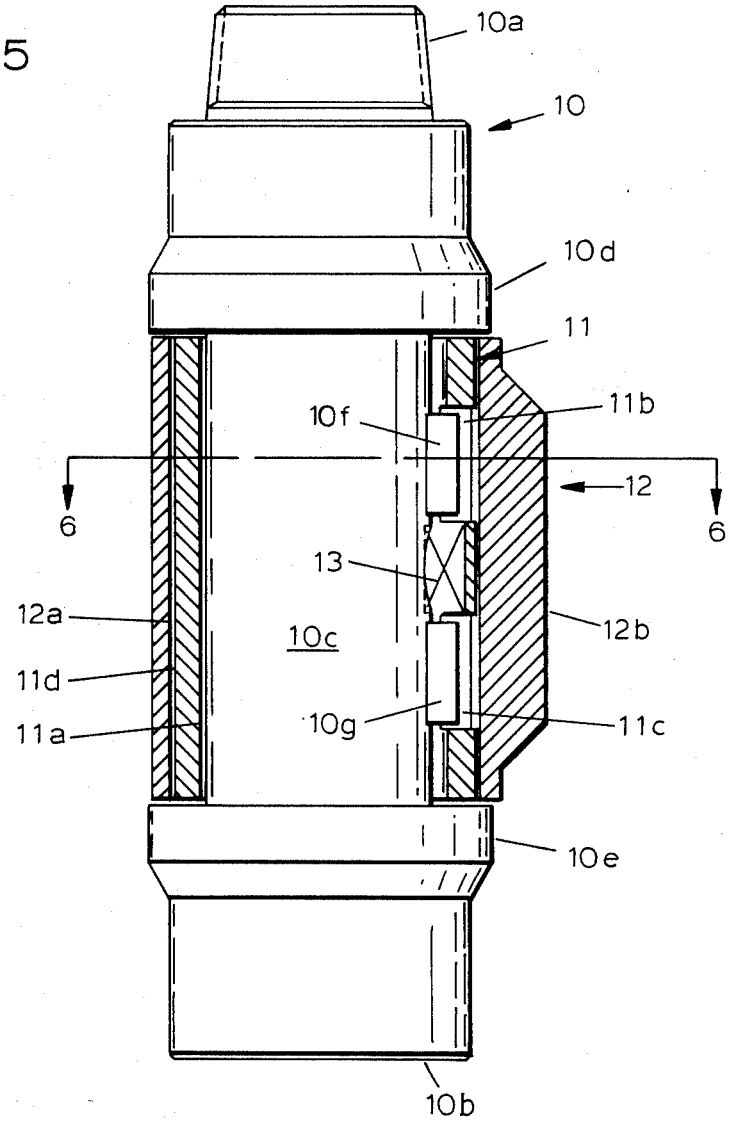
FIG. 5 is an elevation, partly cut away, of an alternate embodiment of the invention with a free-turning outer sleeve.

FIG. 5 represents an alternate embodiment of the tool of this invention in which the sleeve projection is not forced to rotate with the body.

Body 10 is a length of drill string, or a sub, with tool joint pin 10*a* on the upper end, tool joint box 10*b* on the lower end and a generally central bore (not shown) to conduct drilling fluid through the tool. Collars, or flanges, 10*d* and 10*e* are structurally part of the body and axially confine sleeves 11 and 12 on arbor 10*c*. Sleeve 11 has bore 11*a* somewhat larger than the mating outer diameter of arbor 10*c*. Keys 10*f* and 10*g* project radially from the arbor into cooperating keyways 11*b* and 11*c* in sleeve 11. The keyways are deep enough to allow the sleeve 11 to move radially leftward on the arbor. Spring 13 is situated between arbor 10*c* and sleeve 11 and urges sleeve 11 to the right to the position shown. Sleeve 11 has outer cylindrical surface 11*d* bearingly associated with the cylindircal bore 12*a* of sleeve 12. Bore 11*a* and surface 11*d* are not concentric and the bore 12*a* of sleeve 12 is normally displaced from the centerline of body 10, as shown. If not forcefully disturbed, sleeve 12 would rotate about a line displaced from the body centerline in the direction of the bias. Sleeve 12 has projection 12*b*, of some axial length, to engage the well bore wall.

Figure 6:
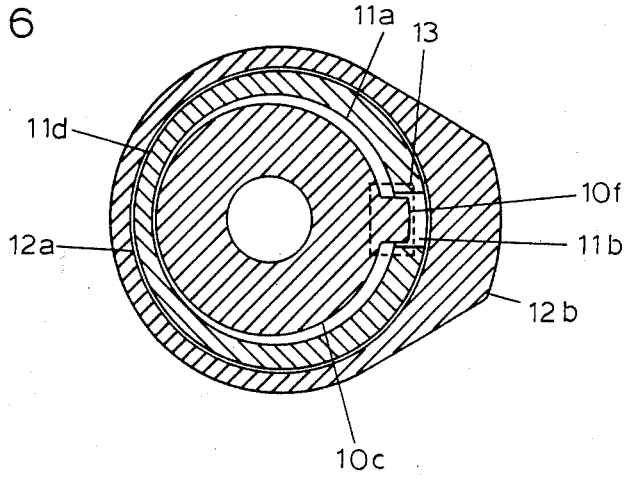
FIG. 6 is a sectional view, somewhat enlarged, of the tool of FIG. 5, taken along line 6—6.

FIG. 6 is a cross section taken along line 6—6 of FIG. 5. When projection 12*b* encounters a well bore wall, sleeve 12 stops rotating. Sleeve 11 rotates with the drill string, driven rotationally by keys 10*f* and 10*g* in keyways 11*b* and 11*c* in sleeve 11. The outer surface 11*d* of sleeve 11 is eccentric relative to the rotational centerline of body 10 and, when rotated 180 degrees relative to sleeve 12, will lift projection 12*b*, briefly, from the well bore wall. There is some frictional drag between sleeves 11 and 12 and sleeve 12 will rotate some each time projection 12*b* is off the well bore wall. The projection will be off the well bore wall a shorter period of time when engaging the near side of the well. The projection will, then, spend a greater percentage of the drilling time in the vicinity of the well bore near side. The bias position coincides with the thickest part of eccentric sleeve 11. This is a construction convenience for the keyways but also extends the maximum reach of projection 12*b* from the body centerline.

In response to radial loading, sleeve 11 can move laterally, overcoming bias spring 13, to reduce the amount of eccentricity of sleeve 11 relative to body 10. Fluid damping, and inertia, retard the movement of sleeve 11 toward a less eccentric position. The retarding action is speed responsive and the overall effect of the tool on the drill string centerline is influenced by rotary speed controllable from the surface. At very low rotary speed, the dashpot effect of fluid displacement by movement of sleeve 11 is negligible and the tool has little effect on the drill string. At greater rotary spped the dashpot effect will have a more pronounced effect on the drill string position. At very high rotary speeds, spring 13 will not have time to restore the sleeve 11 to the eccentric position and the bias produced eccentricity will have no effect.

For some drilling situations, projection 12*b* is made to extend around the circumference of sleeve 12. The outer surface of sleeve 12 will still be biased radially to an eccentricity determined by reaction loads from the well bore wall.

As previously described for tools of FIGS. 1 and 2, there are two principal effects delivered by this tool. First, the tool bounces the centerline of the drill string to disorganize the tendency of a deflected drill string centerline to rotate in a stationary plane while column loaded. This slows bit departure from a planned course. Second, the drill string centerline is displaced from the near side of the well bore by a lateral force. The lateral force can be used in conjunction with conventional stablilizers to achieve a variety of effects upon the drill bit as previously described.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without department from the scope thereof, it is to be understood that all matter herein set forth or shown in the accompanying drawings is to be interpreted as illustrative and not in a limiting sense.

The invention having been described, I claim:

1. A lateral force tool for use as an element of a drill string assembly in a well, the tool comprising:

a body comprising a length of drill string;

a sleeve arranged to encircle said body, said sleeve constrained on and rotationally secured by opposed non-circular surfaces to said body and arranged, by clearances between said surfaces, for limited lateral movement relative to said body;

bias means arranged to urge said sleeve to move in a selected radial direction relative to said body; a projection, of some axial length, extending radially from said sleeve to contact the well bore wall.

2. The tool of claim 1 wherein said sleeve is rotationally secured to said body by a key and cooperating keyway arrangement.

3. The tool of claim 1 wherein said sleeve is rotationally secured to said body by a rectangular length on said body and a cooperating rectangular bore in said sleeve.

4. The tool of claim 1 wherein said radial projection comprises a stabilizer blade extending some axial distance along the outside surface of said sleeve.

5. The tool of claim 1 wherein said radial projection is a generally eccentric outer surfce of said sleeve relative to the sleeve bore centerline.

6. The tool of claim 1 wherein a dashpot means is operatively associated with said body and sleeve, arranged to cooperate with drilling fluid to retard the radial movement of said sleeve on said body.

7. A lateral force well drilling tool for use as an element of a drill string assembly, the tool comprising:

a body comprising a length of drilling string;

a first sleeve arranged to surround said body and axially confined on and rotationally secured, by opposed non-circular surfaces, to said body, said sleeve arranged, by clearance between said surfaces, for some radial movement relative to said body, said sleeve having a cylindrical outer surface that is eccentric relative to a general centerline of the sleeve bore;

a second sleeve, axially constrained on said first sleeve, bearingly supported for rotation about said cyclindrical surface of said first sleeve;

bias means situated to urge said first sleeve in a selected radial direction relative to said body;

a radial projection on the outer surface of said second sleeve and extending for some axial distance along said sleeve outer surface.

8. The tool of claim 7 wherein said outer cylindrical surface on said first sleeve is eccentric relative to a general axial centerline of a bore through said first sleeve.

9. The tool of claim 8 wherein said bias means is situated to urge said first sleeve to move in the radial direction of the displacement of said cylindrical outer surface relative to said general centerline of the sleeve bore.

10. The tool of claim 7 further providing that said radial projection extend periperally around the circumference of said second sleeve.

* * * * *